US005795694A

United States Patent [19]

Uchiyama et al.

[11] Patent Number: 5,795,694

[45] Date of Patent: Aug. 18, 1998

[54] TONER FOR DEVELOPING ELECTROSTATIC IMAGE

[75] Inventors: Masaki Uchiyama, Yokohama; Tatsuya Nakamura, Tokyo; Shinya Yachi, Yokohama, all of Japan

[73] Assignee: Canon Kabushiki Kaisha, Tokyo, Japan

[21] Appl. No.: 649,073

[22] Filed: May 16, 1996

[30] Foreign Application Priority Data

May 19, 1995 [JP] Japan ..... 7-144229

[51] Int. Cl.[6] ..... G03G 9/093

[52] U.S. Cl. ..... 430/109; 430/138

[58] Field of Search ..... 430/109, 110, 430/138

[56] References Cited

U.S. PATENT DOCUMENTS

| | | | |
|---|---|---|---|
| 2,297,691 | 10/1942 | Carlson . | |
| 3,666,363 | 5/1972 | Tanaka et al. . | |
| 4,071,361 | 1/1978 | Marushima . | |
| 4,497,885 | 2/1985 | Ushiyama et al. | 430/106.6 |
| 4,565,764 | 1/1986 | Nakahara et al. | 430/111 |
| 4,954,412 | 9/1990 | Breton et al. | 430/138 |
| 5,079,125 | 1/1992 | Anno et al. | 430/111 |
| 5,153,093 | 10/1992 | Sacripante et al. | 430/138 |
| 5,219,697 | 6/1993 | Mori et al. | 430/110 |
| 5,223,370 | 6/1993 | Sacripante et al. | 430/138 |
| 5,300,386 | 4/1994 | Kanbayashi et al. | 430/99 |
| 5,336,582 | 8/1994 | Takegawa et al. | 430/110 |
| 5,354,640 | 10/1994 | Kanbayashi et al. | 430/110 |
| 5,407,776 | 4/1995 | Kanbayashi et al. | 430/137 |
| 5,510,222 | 4/1996 | Inaba et al. | 430/109 |
| 5,529,873 | 6/1996 | Chiba et al. | 430/109 |

FOREIGN PATENT DOCUMENTS

| | | |
|---|---|---|
| 0533172 | 3/1993 | European Pat. Off. . |
| 0627669 | 12/1994 | European Pat. Off. . |
| 3332621 | 3/1984 | Germany . |
| 36-10231 | 7/1961 | Japan . |
| 42-10799 | 6/1967 | Japan . |
| 42-23910 | 11/1967 | Japan . |
| 43-24748 | 10/1968 | Japan . |
| 51-14895 | 5/1976 | Japan . |
| 58-57105 | 12/1983 | Japan . |
| 61-35457 | 2/1986 | Japan . |
| 61-273558 | 12/1986 | Japan . |
| 62-73277 | 4/1987 | Japan . |
| 64-62666 | 3/1989 | Japan . |
| 64-63035 | 3/1989 | Japan . |
| 1-230073 | 9/1989 | Japan . |
| 3-35660 | 2/1991 | Japan . |
| 5-134437 | 5/1993 | Japan . |
| 6-317925 | 11/1994 | Japan . |
| 2107480 | 3/1983 | United Kingdom . |

OTHER PUBLICATIONS

Patent Abstracts of Japan, vol. 9, No. 26 (P-332) [1749]2/85 for JP 59-170852.

*Primary Examiner*—Roland Martin

*Attorney, Agent, or Firm*—Fitzpatrick, Cella, Harper & Scinto

[57] ABSTRACT

A toner for developing an electrostatic image has toner particles containing a binder resin and a colorant. The toner particle has at least a core composed of a low-temperature softening substance, an inner layer enclosing the core, and an outer layer enclosing the core and the inner layer. The core, the inner layer, and the outer layer are constituted respectively of a material which is discriminable by staining with triruthenium tetroxide and triosmium tetroxide.

20 Claims, 1 Drawing Sheet

SECTIONAL VIEW OF TONER PARTICLE

SECTIONAL VIEW OF TONER PARTICLE

DSC CURVE OF LOW-TEMPERATURE SOFTENING MATERIAL

TONER FOR DEVELOPING ELECTROSTATIC IMAGE

BACKGROUND OF THE INVENTION

1. Field of the Invention

The present invention relates to a toner which is useful for developing electrostatic images and is suitable for fixation by hot-pressing. The present invention also relates to a process for producing the toner.

2. Related Background Art

Electrophotographic methods have been known as shown in U.S. Pat. No. 2,297,691, Japanese Patent Publication Nos. 42-23910 and 43-24748, and so forth. Generally in electrophotography by using a photoconductive material, images are copied or printed by forming an electrostatic image on a photosensitive member, developing the electrostatic image with a toner to form a toner image, transferring the toner image onto a toner image-receiving medium (transfer medium) such as a paper sheet, and fixing the toner image by heating, pressing, hot-pressing, solvent vapor exposure, or a like method.

Various methods have been disclosed for developing and fixing electrostatic images with a toner, and a suitable method is selected for the respective image forming process. Conventionally, the toner used for the above method is produced generally by a process comprising melt-blending a colorant composed of a dye and/or a pigment into a thermoplastic resin to form a uniform dispersion, pulverizing the blended matter, and classifying the pulverized matter to separate toner particles having an intended particle size.

Such a production process produces a toner of sufficiently high quality under some limitations. For example, the colorant-containing resin composition should be brittle to be pulverizable economically by a pulverizing apparatus. However, the colorant-containing resin composition which has been made brittle tends disadvantageously to have broader particle size distribution after a high-speed pulverization to contain relatively larger particles. Moreover, such a brittle toner material tends to be further crushed or pulverized during image development. In such a production process, a fine solid particulate material like a colorant cannot readily be dispersed sufficiently uniformly in a resin. The insufficient dispersion can cause increased fogging, lower image density, lower toner color mixing characteristics, or lower transparency. A colorant which is uncovered on the broken surface of the toner may cause variation of development characteristics of the toner.

To solve the problems involved in the toner produced by the aforementioned pulverization, suspension polymerization for producing the toner is disclosed in Japanese Patent Publication Nos. 36-10231, 42-10799, and 51-14895. In the suspension polymerization, a polymerizable monomer, a colorant, and a polymerization initiator, and optionally a crosslinking agent, a charge-controlling agent, and other additives are mixed to form a monomer composition of a uniform solution or dispersion, and the polymerizable monomer is polymerized in an aqueous medium containing a dispersion stabilizer with agitation by a suitable mixer to form toner particles having a desired particle diameter.

Therefore, the toner produced by the suspension polymerization need not be pulverized, so that the toner material is not required to be brittle or may be used a soft material. Further, the colorant does not become uncovered on the toner particle surface because of the absence of the pulverization process, thereby uniform frictional electrification characteristics of the toner are achievable. Furthermore, the particle classification operation can be omitted to provide cost reduction effects such as saving of energy, shortening of production time, and improvement of process yield.

However, when the toner produced by such a process is further pulverized, it tends to have the colorant uncovered on the particle surface thereof which causes decrease of uniformity of the electrification and variation of the developing characteristics. This phenomenon is significant particularly when the copying or printing is continued under high humidity conditions.

For uniform electrification of the toner, methods have been disclosed, for example, in Japanese Patent Application Laid-Open Nos. 62-73277 and 3-35660, in which the surface layer of toner particles is covered with a resin. In these methods, the absolute value of the electric charge becomes smaller disadvantageously, because only a small amount of charge-controlling agent can be incorporated, although the thick coating layer counteracts the above adverse effects of the uncovered colorant.

To solve the above problem, multi-layer coating of the toner particles is disclosed in Japanese Patent Application Laid-Open Nos. 64-62666 and 64-63035, and Japanese Patent Publication No. 58-57105. However, the production process therefor is complicated and unduly costly.

To overcome such disadvantages, a charge-controlling agent is deposited on the toner particle surface as disclosed in Japanese Patent Application Laid-Open Nos. 61-273558 and 5-134437. This method, however, causes a problem in the release of the charge-controlling agent from the toner surface which reduces the toner durability in copying or printing a plurality of sheets.

In recent years, digital full-color copying machines and printers are commercialized which have been capable of producing images of high quality with high resolution, high gradation, high color reproducibility without color irregularity. In a digital full-color copying machine or printer, the color of an original color image is separated into elemental colors by use of filters of B (blue), G (green), and R (red);. Electrostatic images constituted of dots of a diameter ranging from 20 to 70 μm corresponding to the original image are developed with toners of Y (yellow), M (magenta), C (cyan), and Bk (black) according to the subtractive color mixing principle. In color copying or printing, the particles of the toner are required to be finer in size to obtain fine dots for high image quality since the toners are transferred in larger amounts than in monochromatic copying from the photosensitive members onto the toner image-receiving medium.

Improvement of the low-temperature fixability of the toner is important in consideration of future increases in the printing speed and of future progress in full-color copying. From this standpoint, the toner produced by polymerization is preferred since it can be produced relatively easily in fine particle size with sharp particle size distribution.

The colors of the respective color toners used in a full-color copying machine or a full-color printer should be miscible sufficiently with each other in the fixation step. In full-color copying or printing, color reproducibility is important, and transparency of an overhead projector (abbreviated as OHP) image is required. Further, the color toners are desirably composed of a lower molecular weight resin to be more readily fusible than the black toner.

For a black toner, a relatively highly crystalline wax such as polyethylene waxes and polypropylene waxes is used as a releasing agent in order to improve the high-temperature offset resistance at the image fixation step. In full-color image formation for OHP, however, the high crystallinity of the wax lowers the transparency of the formed image.

Therefore, a releasing agent is not usually incorporated into color toners, but an offset-preventing agent such as a silicone oil is applied onto a hot-fixing roller to improve the high-temperature offset resistance. However, the excess silicone oil adhering onto a toner image-receiving medium may undesirably provides the user with an unpleasant feeling on handling the medium after the fixation. To solve this problem, an oil-free fixing toner was investigated which contains a large amount of low-temperature softening substance in a toner particle. A toner is demanded which is superior in low-temperature fixability and transparency and has high-temperature offset resistance.

To solve these problems, Japanese Patent Application Laid-Open No. 1-230073 discloses a color image fixing process employing a polymerized toner containing a low-temperature softening substance having releasability. This toner is liable to deteriorate in toner developing properties during many sheets of copying or printing, which is considered to be ascribable to exudation of the low-temperature softening substance to the toner particle surface.

Japanese Patent Application Laid-Open No. 61-35457 describes addition of a polar polymer or copolymer to the polymerizable monomer composition to prevent exposure of the colorant or the exudation of the low-temperature softening substance to the toner particle surface. Japanese Patent Application Laid-Open No. 6-317925 discloses formation of a hydrophilic outer shell on the surface of the toner particles for the same purpose. However, the hydrophilicity of the shell-forming material will impair the development characteristics of the toner under high humidity conditions. Further, in this method, the glass transition temperature of the core resin is set at a temperature ranging from 10° C. to 50° C. in order to reduce the interruption of fixing by the shell material, which tends to cause sticking of the toner image-receiving medium onto the fixing roller in toner image fixation.

Accordingly, a toner, in particular a color toner, is desired which is produced by polymerization and yet does not involve the aforementioned problems in development characteristics and fixation characteristics.

SUMMARY OF THE INVENTION

An object of the present invention is to provide a toner for developing an electrostatic image which does not involve the aforementioned problems of the prior art.

Another object of the present invention is to provide a toner for developing an electrostatic image which is constituted of a core portion, an inner layer, and an outer layer, each having a function separated from each other.

Still another object of the present invention is to provide a toner for developing an electrostatic image which has frictional electrification characteristics excellent and stable under various environmental conditions.

A further object of the present invention is to provide a toner for developing an electrostatic image which is capable of forming a toner image of high quality with a high image density and less fogging.

A still further object of the present invention is to provide a toner for developing an electrostatic image which is scattered less in an image forming apparatus.

A still further object of the present invention is to provide a toner for developing an electrostatic image which has high durability after many sheets of copying or printing.

A still further object of the present invention is to provide a toner for developing an electrostatic image which is constituted of color toner particles excellent in color mixing properties and capable of forming transparent image.

A still further object of the present invention is to provide a process for producing the above toner.

The toner for developing an electrostatic image of the present invention comprises toner particles containing a binder resin and a colorant, the toner particle having at least a core composed of a low-temperature softening substance, an inner layer enclosing the core, and an outer layer enclosing the core and the inner layer; and the core, the inner layer, and the outer layer being constituted respectively of a material which is discriminable by staining with triruthenium tetroxide and triosmium tetroxide.

The process for producing the toner of the present invention comprises steps of preparing a polymerizable monomer composition containing at least a polymerizable monomer, a colorant, a low-temperature softening substance, a resin having a polar group, and a polymerization initiator; dispersing the polymerizable monomer composition in an aqueous medium to form particles thereof; polymerizing the polymerizable monomer in the particles to form toner particles; heating the aqueous medium to a temperature higher by 5° C. or more than endothermic main peak temperature of the low-temperature softening substance and higher by 5° C. or more than the glass transition temperature of the resin having the polar group; and subsequently cooling the aqueous medium at a cooling rate of not more than 2° C. per minute down to 50° C.; and collecting the toner particles from the aqueous medium by filtration, wherein the toner particle has at least a core composed of a low-temperature softening substance, an inner layer enclosing the core, and an outer layer enclosing the core and the inner layer; and the core, the inner layer, and the outer layer being constituted respectively of a material which is discriminable by staining with triruthenium tetroxide and triosmium tetroxide.

DESCRIPTION OF THE PREFERRED EMBODIMENTS

The toner particle of the present invention is constructed at least from a core composed of a low-temperature softening substance, an inner layer enclosing the core, and an outer layer enclosing the core and the inner layer, wherein the core, the inner layer, and the outer layer are composed respectively of a material which is discriminable by observation, by transmission electron microscopy, of slices of the toner particle encased in an epoxy resin or the like stained with triruthenium tetroxide and triosmium tetroxide. A colorant, a charge-controlling agent, and a low-temperature softening substance are incorporated in suitable amounts in the toner particles to exhibit excellent developing characteristics and fixation characteristics. This is different from the conventional method in which the toner is thickly covered with a polymer, or a charge controlling agent is allowed to adhere onto the toner particle surface to improve the toner durability and to decrease fine electrification irregularities on the toner particle surface.

The preferred embodiments of the present invention are described below in detail.

The outer layer of the toner of the present invention has a thickness ranging preferably from 0.01 to 0.5 μm as measured by transmission electron microscopy to achieve sufficient effects of the present invention. The outer layer of thickness of less than 0.01 μm is not capable of covering completely the colorant and the low-temperature softening substance, whereas the outer layer of thickness of more than 0.5 μm tends to impair the fixation properties of the toner. The outer layer has more preferably a thickness ranging from 0.05 to 0.4 μm.

Figure 1:
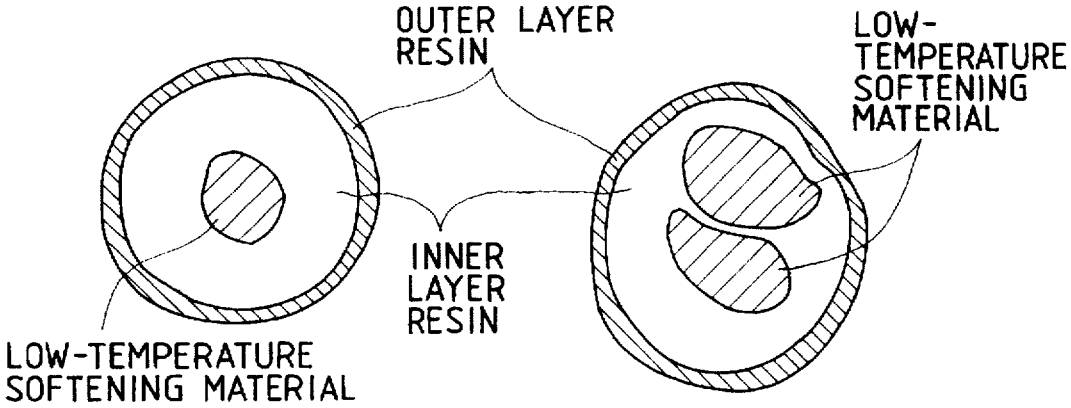
FIG. 1 shows schematic sectional views of the toner particles of the present invention.

The morphology of the cross-section of the toner particle is observed specifically as below in the present invention. The toner particles are sufficiently dispersed in an epoxy resin which is curable at ordinary temperature, and then the resin is cured by standing at a temperature of 40° C. for two days. The cured product is sliced into a thin film sample by use of a microtome having a diamond cutter. The sample is stained with combination of triruthenium tetroxide and triosmium tetroxide to cause slight difference of staining depending on the crystallinities. The difference is observed by transmission electron microscopy (TEM). FIG. 1 shows schematically a typical example thereof.

The particulate toner of the present invention is preferably produced by polymerization including suspension polymerization in an aqueous medium, emulsion polymerization, interfacial polymerization, dispersion polymerization, and association polymerization. The outer layer should be formed from a material which can be discriminated from the core or central portion and the inner layer by staining with triruthenium tetroxide and triosmium tetroxide.

The outer layer is preferably prepared from a resin having a polar group, a glass transition temperature ranging from 55° to 80° C., and an acid value ranging from 1 to 35, more preferably from 5 to 35. The polar group-containing resin is dissolved in the polymerizable monomer composition. In the following step of forming liquid particles of the polymerizable monomer composition in a toner particle size in the aqueous medium, the polar group-containing resin migrates to the proximity of the surface of the liquid particles, and forms satisfactorily the outer layer of the toner particles in the subsequent polymerization step and the cooling step.

The polar group-containing resin having a glass transition temperature of lower than 55° C. will form an outer layer of the toner having low strength which results in poor transferability and poor durability of the toner, whereas the polar group-containing resin having a glass transition temperature of higher than 80° C. will form an outer layer of the toner having excessively high strength, tending to hinder the effect of the charge-controlling agent in the interior to extend onto the toner surface, to lower charge stability of the toner, and to cause variation of the developing characteristics. Further, the polar group-containing resin having an acid value of lower than 1 will form an outer layer of lower strength to lower the transferability and the durability of the toner, whereas the polar group-containing resin having an acid value of higher than 35 tend to cause deposition of the colorant or the low-temperature softening compound on the toner particle surface.

The glass transition temperature of the resin is measured by a differential scanning calorimeter, DSC-7 manufactured by Perkin Elmer Co., according to ASTM D3418-8. The detector is corrected by the melting points of indium and zinc, and the heat quantity is corrected by the heat of fusion of indium. The measurement is conducted with the sample placed in an aluminum pan and with an empty pan as the reference at a temperature elevation rate of 10° C. per minute. The acid value of the resin is measured according to JIS K-0070.

The polar group-containing resin is added in an amount ranging preferably from 1 to 20 parts by weight, more preferably from 2.5 to 15 parts by weight based on 100 parts by weight of the binder resin in the toner. At the content of the polar group-containing resin of lower than 1 part by weight, the function of the outer layer of the toner particle is lower, whereas at the content thereof of higher than 20 parts by weight, the excessive amount results in lower charging stability of the toner.

As the polar group-containing resin, preferred are polyester resins and derivatives thereof.

The alcohol component of the typical polyester resin includes diols such as ethylene glycol, propylene glycol, butanediol, diethylene glycol, triethylene glycol, pentanediol, hexanediol, neopentylglycol, hydrogenated bisphenol A, bisphenol derivatives represented by Formula (I) below:

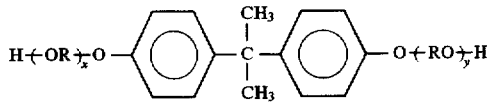

(I)

where R is an ethylene group or a propylene group, x and y are respectively an integer of 1 or more and the average value of x+y is in the range of from 2 to 10; and diols represented by Formula (II) below:

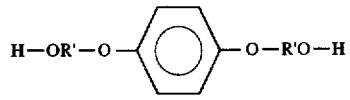

(II)

where R' is $—CH_2CH_2—$, $—CH_2—CH(CH_3)—$, or $—CH_2—C(CH_3)_2—$.

The dicarboxylic acid constituting not less than 50 mol % of the entire acid component of the polyester resin includes benzene dicarboxylic acids and anhydrides thereof such as phthalic acid, terephthalic acid, isophthalic acid, phthalic anhydride; and alkyl dicarboxylic acids and anhydrides thereof such as succinic acid, adipic acid, sebacic acid, and azelaic acid.

The alcohol component includes also polyhydric alcohols such as glycerine, pentaerythritol, sorbitol, sorbitan, and oxyalkylene ethers of novolak type phenol resins as the alcohol component. The acid component includes also polycarboxylic acids and anhydrides such as trimellitic acid, pyromellitic acid, and benzophenone tetracarboxylic acid.

The particularly preferred alcohol components of the polyester resin are the bisphenol derivatives represented by Formula (I), and the particularly preferred acid components thereof are phthalic acid, terephthalic acid, isophthalic acid, and trimellitic acid, and anhydrides thereof.

The polymerizable monomer which is useful for forming the particulate toner of the present invention is a vinyl type polymerizable monomer, including styrene; styrene derivatives such as α-methylstyrene, β-methylstyrene, o-methylstyrene, m-methylstyrene, p-methylstyrene, 2,4-dimethylstyrene, p-n-butylstyrene, p-t-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic polymerizable monomers such as methyl acrylate, ethyl acrylate, n-propyl acrylate, isopropyl acrylate, n-butyl acrylate, isobutyl acrylate, t-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethylphosphatoethyl acrylate, diethylphosphatoethyl acrylate, dibutylphosphatoethyl acrylate, and 2-benzoyloxyethyl acrylate; methacrylic polymerizable monomers such as methyl methacrylate, ethyl methacrylate, n-propyl methacrylate, isopropyl methacrylate, n-butyl methacrylate, isobutyl methacrylate, t-butyl methacrylate, n-amyl methacrylate, n-hexyl methacrylate, 2-ethylhexyl methacrylate, n-octyl methacrylate, n-nonyl methacrylate, diethylphosphatoethyl methacrylate, and dibutylphosphatoethyl methacrylate; methylene aliphatic monocarboxylic acid esters; vinyl esters such as vinyl acetate, vinyl propionate, vinyl butyrate, vinyl benzoate, and vinyl formate; vinyl ethers such as vinyl methyl ether, vinyl ethyl ether, and vinyl isobutyl ether; and vinyl ketones such as vinyl methyl ketone, vinyl hexyl ketone, and vinyl isopropyl ketone.

The inner layer of the toner particle of the present invention is constituted of a vinyl polymer derived from such a polymerizable vinyl monomer. Of the vinyl polymers, preferred are styrene polymers, styrene-acrylate copolymers, and styrene-methacrylate copolymers to cover effectively the low-temperature softening substance of the core or the central portion.

Of the above polymers and copolymers, those are preferred which have a glass transition temperature of higher than 50° C. and lower than 100° C. The polymer or copolymer having the glass transition temperature of not higher than 50° C. tends to adhere strongly to the fixing means such as a fixing roller to prevent the toner image-bearing recording medium from separating from the fixing means and to cause sticking of the recording medium to the fixing roller, and tends to lower the strength of the entire toner particles to impair the transferability and development characteristics during many sheets of copying. Such a polymer or copolymer can also cause sticking between the formed toner images stored one over another for a long time owing to the lower glass transition temperature of the polymer. On the other hand, the polymer or copolymer having a glass transition temperature of not lower than 100° C. tends to cause insufficient fixation of the toner image.

The polymer or copolymer preferably has the main peak of molecular weight distribution in the range of from 10,000 to 50,000 as measured by gel permeation chromatography (GPC) in order to encapsulate the larger amount of the low-temperature softening substance existing in the core. The polymer or copolymer having the main peak of the molecular weight at lower than 10,000 exhibits weak interaction between the polymer molecule chains, thereby causing insufficient coverage of the low-temperature softening substance constituting the core or the central portion to deteriorate the development characteristics owing to the low-temperature softening substance. On the other hand, the polymer or copolymer having the main peak of the molecular weight at higher than 50,000 exhibits excessively strong interaction between the polymer molecule chains to hinder the exudation of the low-temperature softening substance to the toner surface on the hot-press fixation and to cause insufficiency of fixation or low-temperature offset when the fixation temperature is relatively low.

A styrene or styrene copolymer which has the main peak of molecular weight in the range of from 15,000 to 40,000 employed will impart sufficient strength and excellent frictional electrification characteristics to the toner particles, thereby exhibiting satisfactory development characteristics. The sufficient strength of the toner particles maintains stable transferability and development characteristics without deterioration of the toner in a durability test.

The molecular weight of the polymer or copolymer is determined by gel permeation chromatography (GPC). Specifically, the toner is extracted with toluene by a Soxhlet extractor for 20 hours; the toluene is evaporated by a rotary evaporator to obtain an extract; the extract is washed, if necessary, sufficiently with an organic solvent (for example, chloroform) which does not dissolve the polymer or copolymer; the residue is dissolved in tetrahydrofuran (THF); the solution is filtered through a solvent-resistant membrane filter of 0.3 μm pore diameter to obtain a sample solution; and the sample solution is subjected to molecular weight distribution measurement by means of a GPC apparatus, 150 C manufactured by Waters Co., with a series of columns of A-801, 802, 803, 804, 805, 806, 807 produced by Showa Denko K. K. with calibration by standard polystyrene resins.

The low-temperature softening substance for constituting the core or the central portion of the toner particle of the present invention is preferably a compound having the main peak of endothermic curve of DSC in the range of preferably from 55° to 120° C., more preferably from 60° to 90° C. as measured according to ASTM D-3418-8 in a similar manner as in measurement of the glass transition temperature. In particular, a low-temperature softening compound showing tangential-separation temperature of not lower than 40° C. in the DSC curve is preferred more. The low-temperature softening substance having the endothermic main peak at a temperature of lower than 55° C. has self-cohesiveness insufficient to form the core or the central portion of the toner, emerging on the surface of the toner to affect adversely the development characteristics. Further the compound having the tangential-separation temperature of lower than 40° C. decreases the strength of the toner particles, tending to impair the development characteristics during many sheets of copying. The obtained fixed image is liable to become sticky owing to the low melting point of the low-temperature softening substance.

Figure 2:
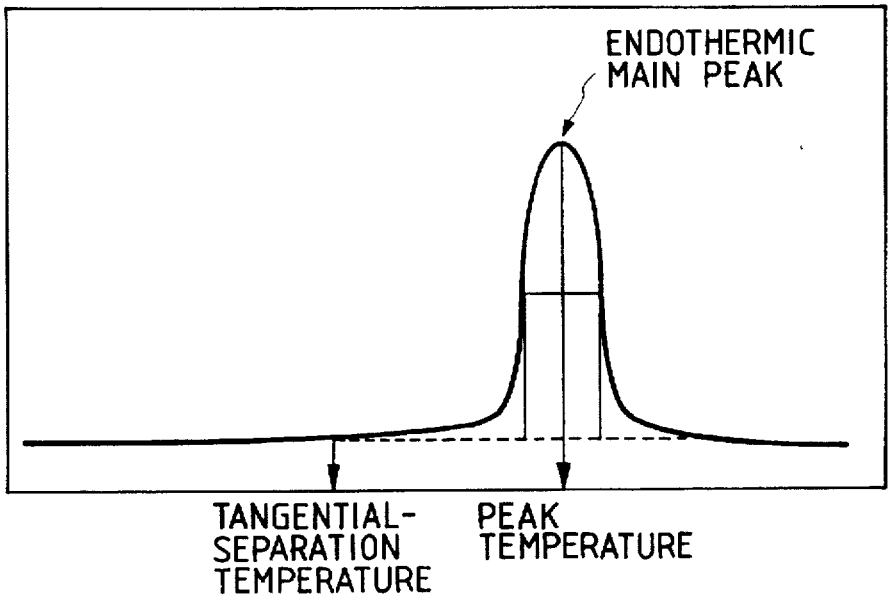
FIG. 2 shows schematically a DSC curve of a low-temperate softening material employed in the present invention.

On the other hand, the low-temperature softening substance having the endothermic main peak at a temperature of higher than 120° C. does not readily exude on fixation step, impairing the low-temperature fixability of the toner. Further, when the toner particles are produced by direct polymerization, such a low-temperature softening substance may be not sufficiently soluble in the polymerizable monomer composition, and may deposit during formation of the liquid drops of polymerizable monomer composition in a toner size in an aqueous medium to interrupt the toner particle formation. The temperature of the main peak of the endothermic curve of the low-temperature softening substance is more preferably in the range of from 60° to 90° C., still more preferably from 60° to 85° C. FIG. 2 shows schematically a DSC endothermic curve of the low-temperature softening substance. Further, the low-temperature softening substance has preferably a sharp fusion property, i.e., endothermic main peak with a half-width of not more than 10° C., more preferably not more than 5° C.

The low-temperature softening substance is preferably a wax which is solid at room temperature, including specifically paraffin waxes, polyolefin waxes, Fischer-Tropsch waxes, amide waxes, higher fatty acids, and ester waxes, and their derivatives such as grafted compounds and blocked compounds. Particularly preferred are ester waxes having one or more long chain ester moieties of 10 or more carbons as shown by the general formulas below since they do not impair the transparency in OHP and yet have resistance to high temperature offsetting. The typical ester waxes suitable for the present invention are shown specifically by the general structural formulas (1) to (6):

Ester Wax (1):

$$[R_1—COO—(CH_2)_n]_a—C—[(CH_2)_m—OCO—R_2]_b$$

where a and b are respectively an integer of 0 to 4 and a+b is 4; $R_1$ and $R_2$ are respectively an organic group of 1 to 40 carbons, and the difference of carbon numbers between $R_1$ and $R_2$ is not less than 10; and n and m are respectively an integer of 0 to 15 and are not simultaneously zero.

Ester Wax (2):

$$[R_1-COO-(CH_2)_n]_a-C-[(CH_2)_m-OH]_b$$

where a and b are respectively an integer of 0 to 4 and a+b is 4; $R_1$ is an organic group of 1 to 40 carbons; and n and m are respectively an integer of 0 to 15 and not simultaneously zero.

Ester wax (3):

$$[R_1-COO-(CH_2)_n]_a-\overset{\overset{R_3}{|}}{C}-[(CH_2)_m-OCO-R_2]_b$$

where a and b are respectively an integer of 0 to 3 and a+b is 3 or less; $R_1$ and $R_2$ are respectively an organic group of 1 to 40 carbons, and the difference of carbon numbers between $R_1$ and $R_2$ is not less than 10; $R_3$ is an organic group of one or more carbons; and n and m are respectively an integer of 0 to 15 and not simultaneously zero.

Ester Wax (4):

$$R_1COOR_2$$

where $R_1$ and $R_2$ are independently a hydrocarbon group of 1 to 40 carbons.

Ester Wax (5):

$$R_1COO(CH_2)_nOOCR_2$$

where $R_1$ and $R_2$ are independently a hydrocarbon group of 1 to 40 carbons, and n is an integer of 2 to 20, and Ester Wax (6):

$$R_1OOC(CH_2)_nCOOR_2$$

where $R_1$ and $R_2$ are independently a hydrocarbon group of 1 to 40 carbons, and n is an integer of 2 to 20.

The ester wax employed suitably in the present invention has a melt viscosity ranging from 1 to 50 mPa·sec at 100° C. The melt viscosity of the ester wax is measured, for example, by Viscotester VT500 manufactured by Haake Co. The ester wax having the melt viscosity of lower than 1 mPa·sec is less effective in high-temperature offset prevention effect, whereas the ester wax having the melt viscosity of higher than 50 mpa·sec exudes less readily on the fixation to impair the low-temperature fixability.

The low-temperature softening substance has a weight-average molecular weight (Mw) ranging preferably from 300 to 1,500. The low-temperature softening substance having the molecular weight of lower than 300 is liable to emerge on the surface of the toner particle, whereas the material having the molecular weight of higher than 1,500 lowers the low-temperature fixability. The molecular weight is preferably in the range of from 400 to 1,250. Further, the low-temperature softening substance having the ratio of the weight-average molecular weight to the number-average molecular weight (Mw/Mn) of 1.5 or less shows a sharp maximum peak of DSC endothermic curve, and gives particularly excellent toner properties with improved mechanical strength of the toner particles at room temperature and sharp melting characteristics.

The molecular weight of the low-temperature softening substance is measured by GPC under the conditions below:

(GPC Measurement Conditions)

Apparatus: GPC-150C (Waters Co.)

Column: GMH-HT 30 cm, 2 columns (Tosoh Corp.)

Temperature: 135° C.

Solvent: o-Dichlorobenzene (addition of 0.1% ionol)

Flow rate: 1.0 mL/min

Sample: 0.15%, 0.4 mL

The molecular weight of the sample is calculated by using a calibration curve prepared by use of standard monodisperse polystyrenes, and is converted to polyethylene equivalent by the conversion equation derived from the Mark-Houwink viscosity equation.

The low-temperature softening substance includes specifically:

(1) $CH_3(CH_2)_{20}COO(CH_2)_{21}CH_3$ (2) $CH_3(CH_2)_{17}COO(CH_2)_9OOC(CH_2)_{17}CH_3$ (3) $CH_3(CH_2)_{17}OOC(CH_2)_{18}COO(CH_2)_{17}CH_3$

In recent years, double-sided full-color image printing is demanded increasingly. When the double-sided printing is conducted, the toner image formed firstly on the surface of a recording medium possibly passes again the heater portion of the fixation device on image formation on the reverse face of the medium. Therefore, the high-temperature offset resistance of the previously fixed toner image should be sufficient. For this purpose, a large amount of the low-temperature softening substance is encapsulated preferably in a toner particle in the present invention. Specifically, the low-temperature softening substance is incorporated into the toner particle in an amount preferably ranging from 5 to 30% by weight. At the content thereof in the toner of lower than 5% by weight, the high-temperature offset resistance is lower, and in double-sided printing, an image on a reverse face can be offset in fixation. At the content of higher than 30% by weight, the toner particles are liable to coalesce in particle formation in polymerization in the toner production to produce a toner of broad particle size distribution.

A charge-controlling agent is preferably incorporated into the toner particles for the purpose of controlling the electrification characteristics of the toner in the present invention. The charge-controlling agent is preferably selected which hardly inhibits polymerization and barely migrates into the water phase. For example, the positive charge-controlling agent includes nigrosine dyes, triphenylmethane dyes, quaternary ammonium salts, guanidine derivatives, imidazole derivatives, and amine compounds. The negative charge-controlling agent includes metal-containing salicylic acid type compounds, metal-containing monoazo dye compounds, urea derivatives, styrene-acrylic acid copolymers, and styrene-methacrylic acid copolymers. The charge-controlling agent is added in an amount of from 0.1% to 10% by weight based on the binder resin or the polymerizable monomer.

The polymerization initiator employed in producing the toner particles by polymerization includes azo or diazo type initiators such as 2,2'-azobis(2,4-divaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; and peroxide type initiators such as benzoyl peroxide, methyl ethyl ketone peroxide, diisopropyl oxycarbonate, cumene hydroperoxide, 2,4-dichlorobenzoyl peroxide, and lauroyl peroxide. The polymerization initiator is used solely or in combination in an amount of from 0.5 to 20% by weight of the polymerizable monomer.

For controlling the molecular weight of the binder resin of the toner, a crosslinking agent or a chain transfer agent may be added preferably in an amount of from 0.001% to 15% by weight of the polymerizable monomer.

To the aqueous dispersion medium for the polymerization, a dispersion stabilizer is added for stabilizing the dispersion of the particles of the polymerizable monomer composition in the medium. The dispersion stabilizer includes fine powdery inorganic compounds such as calcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina; and organic compounds such as polyvinyl alcohol, gelatin, methylcellulose, methylhydroxypropylcellulose, ethylcellulose, sodium salt of carboxymethylcellulose, polyacrylic acid and salts thereof, polymethacrylic acid and salts thereof, and starch. The dispersion stabilizer is used in an amount of 0.2 to 20 parts by weight based on 100 parts by weight of the polymerizable monomer.

The inorganic compound used as the dispersion stabilizer may be formed in the dispersion medium to obtain a finer size of particles although a commercial product may be used without modification. For example, calcium phosphate is formed by mixing an aqueous sodium phosphate solution and an aqueous calcium chloride solution with vigorous agitation.

For finely dispersing the dispersion stabilizer a surfactant may be used in an amount of from 0.001 to 0.1 part by weight based on 100 parts by weight of the polymerizable monomer. The surfactant is added to promote the initial effect of the aforementioned dispersion stabilizer. Specifically, the surfactant includes sodium dodecylbenzenesulfate, sodium tetradecylsulfate, sodium pentadecylsulfate, sodium octylsulfate, sodium oleate, sodium laurate, sodium octanoate, sodium stearate, and calcium oleate.

A known colorant may be employed in the present invention.

The black pigment includes carbon black, aniline black, non-magnetic ferrite, and magnetite.

The yellow pigment includes yellow iron oxide, Naples Yellow, Naphthol Yellow S, Hansa Yellow G, Hansa Yellow 10G, Benzidine Yellow G, Benzidine Yellow GR, Quinoline Yellow lake, Permanent Yellow NCG, and tartrazine lake.

The orange pigment includes Permanent Orange GTR, Pyrazolone Orange, Vulcan Orange, Benzidine Orange G, Indanthrene Brilliant Orange RK, and Indanthrene Brilliant Orange GK.

The red pigment includes red iron oxide, Permanent Red 4R, Lithol Red, Pyrazolone Red, calcium salt of Watchung Red, Lake Red C, Lake Red D, Brilliant Carmine 6B, Brilliant Carmine 3B, Eosine Lake, Rhodamine Lake B, and Alizarine Lake.

The blue pigment include Alkali Blue Lake, Victoria Blue Lake, Phthalocyanine Blue, non-metal Phthalocyanine Blue, Phthalocyanine Blue partial chloride, Fast Sky Blue, and Indanthrene Blue BG.

The violet pigment includes Fast Violet B, and Methyl Violet Lake.

The green pigment includes Pigment Green B, Malachite Green Lake, and Final Yellow Green G.

The white pigment includes zinc white, titanium oxide, antimony white, and zinc sulfide.

These colorants may be used solely, or in a mixture or solid solution of two or more thereof.

The colorant is selected in consideration of hue angle, color saturation, lightness, weatherability, OHP transmissivity, and dispersibility in the toner. The colorant is used in an amount ranging preferably from 1 to 20 parts by weight based on 100 parts by weight of the resin. A magnetic material employed as the black colorant is used in an amount ranging preferably from 30 to 150 parts by weight based on 100 parts by weight of the resin, being different from other colorants.

In the case where the electrostatic latent image developing agent of the present invention is used as a light-transmissive color toner, the pigments below are useful for the respective color.

The yellow pigment therefor includes C.I. 10316 (Naphthol Yellow S), C.I. 11710 (Hansa Yellow 10G), C.I. 11660 (Hansa Yellow 5G), C.I. 11670 (Hansa Yellow 3G), C.I. 11680 (Hansa Yellow G), C.I. 11730 (Hansa Yellow GR), C.I. 11735 (Hansa Yellow A), C.I. 117408 (Hansa Yellow RN), C.I. 12710 (Hansa Yellow R), C.I. 12720 (Pigment Yellow L), C.I. 21090 (Benzidine Yellow), C.I. 21095 (Benzidine Yellow G), C.I. 21100 (Benzidine Yellow GR), C.I. 20040 (Permanent Yellow NCG), C.I. 21220 (Vulcan Fast Yellow 5), and C.I. 21135 (Vulcan Fast Yellow R).

The red pigment includes C.I. 12055 (Stalin I), C.I. 12075 (Permanent Orange), C.I. 12175 (Resol Fast Orange 3GL), C.I. 12305 (Permanent Orange GTR), C.I. 11725 (Hansa Yellow 3R), C.I. 21165 (Vulcan Fast Orange GG), C.I. 21110 (Benzidine Orange G), C.I. 12120 (Permanent Red 4R), C.I. 1270 (Para Red), C.I. 12085 (Fire Red), C.I. 12315 (Brilliant Fast Scarlet), C.I. 12310 (Permanent Red F2R), C.I. 12335 (Permanent Red F4R), C.I. 12440 (Permanent Red FRL), C.I. 12460 (Permanent Red FRLL), C.I. 12420 (Permanent Red F4RH), C.I. 12450 (Light Fast Red Toner B), C.I. 12490 (Permanent Carmine FB), and C.I. 15850 (Brilliant Carmine 6B).

The blue pigment includes C.I. 74100 (non-metal Phthalocyanine Blue), C.I. 74160 (Phthalocyanine Blue), and C.I. 74180 (Fast Sky Blue).

In the production of the toner by polymerization in the present invention, the colorant is selected which does not inhibit the polymerization and does not migrate to the aqueous phase. The surface of the colorant may be modified, if necessary, by treatment with a non-polymerization inhibiting material for hydrophobicity. It should be considered in selecting the colorants that many dyes and carbon black can be a polymerization inhibitor.

One preferred method for treating the dye is to polymerize the polymerizable monomer in the presence of the dye, and to add the resulting colored polymer to the polymerizable monomer composition. Carbon black as the colorant may be treated as above, or may be treated with a substance reactive to the surface functional groups of the carbon black (for example, an organosiloxane).

The toner of the present invention to be used as a magnetic toner may contain a powdery magnetic material therein. Such a powdery magnetic material is the one which is magnetized in a magnetic field, and includes powder of ferromagnetic metals such as iron, cobalt, and nickel, and powder of magnetic iron oxides such as magnetite, and ferrite.

In the production of the toner by polymerization in the present invention, the magnetic material should not inhibit the polymerization and should not migrate to the aqueous phase. If necessary, the surface of the magnetic material is preferably modified by treatment with a non-polymerization inhibiting material for hydrophobicity.

In the later half period of polymerization for the toner particle production, the polymerization temperature may be elevated. Further, in the later half period or after completion of the polymerization, a part of the aqueous medium may be distilled off from the reaction system to eliminate the unreacted monomer or a by-product which would cause odor at the toner fixation step. After the completion of the polymerization reaction, the resulting particulate toner is washed, collected by filtration, and dried.

In the suspension polymerization, water is preferably used as the dispersion medium in an amount ranging from 300 to 3,000 parts by weight based on 100 parts by weight of the polymerizable monomer composition.

To differentiate clearly the functions of the core or central portion, the inner layer, and the outer layer, preferably the resulting particulate toner is heat-treated at a temperature higher than the endothermic main peak temperature of DSC endothermic curve of the low-temperature softening substance constituting the core or central portion, and higher than the glass transition temperature of the polymer or copolymer constituting the inner layer, and yet higher than the glass transition temperature of the polar group-containing resin constituting the outer layer for a time of not less than 60 minutes, preferably from 90 to 600 minutes, and then it is cooled at a cooling rate of not higher than 2° C. per minute, preferably in the range of from 0.25° C. to 1.5° C. per minute.

Therefore, preliminarily the endothermic main peak temperature of the low-temperature softening substance is measured, the glass transition temperature of the polar group-containing resin is measured, and the theoretical glass transition temperature is calculated for the polymer or copolymer from the composition and the ratio of the polymerizable monomer or monomers, preliminarily.

The heat treatment temperature is higher than the endothermic main peak temperature of the low-temperature softening substance by 5° C. or more, preferably by 5° to 20° C., higher than the glass transition temperature of the polar group-containing resin added to the polymerizable monomer composition by 5° C. or more, preferably by 5° to 20° C., and higher than the theoretical glass transition temperature of the synthesized polymer or copolymer by 5° C. or more, preferably by 7.5° to 30° C.

For further higher quality of the image, the toner has a weight-average particle diameter in the range of from 4 to 8 μm with its variation coefficient A of not more than 35% in particle number distribution. The toner having a weight-average particle diameter of less than 4 μm is liable to cause fogging, or non-uniformity of the image resulting from insufficient toner transfer, whereas the toner having a weight average particle diameter of more than 8 μm is liable to cause fusion-adhesion onto the photosensitive member or the transfer medium. At the variation coefficient of the toner of more than 35% in particle number distribution, the above tendency is more remarkable.

The present invention is described more specifically below by reference to examples and comparative examples.

EXAMPLE 1

In a four-necked vessel, were placed 710 parts by weight of deionized water, and 850 parts by weight of aqueous 0.1M/L $Na_3PO_4$ solution, and the mixture was maintained at 60° C. with agitation at 12,000 rpm by a high-speed agitator, TK-Homomixer. Thereto, 68 parts by weight of aqueous 1.0M/L $CaCl_2$ solution was added gradually to prepare an aqueous dispersion medium containing, $Ca_3(PO_4)_2$, a slightly water-soluble fine dispersion stabilizer.

Separately, the components below were mixed and dispersed by means of an attritor for 3 hours:

| | |
|---|---|
| Styrene monomer | 165 parts by weight |
| n-Butyl acrylate | 35 parts by weight |
| Copper phthalocyanine pigment | 13 parts by weight |
| Polyester resin (terephthalic acid-(propylene oxide-modified bisphenol A)-(ethylene oxide-modified bisphenol A), acid value: 13, glass transition temperature: 60° C., Mw: 12000, Mn: 5700) | 7 parts by weight |
| Negative charge-controlling agent (chromium compound of dialkyl salicylic acid) | 1 part by weight |
| Low-temperature softening compound (Ester wax (3), endothermic main peak temperature: 81° C., half-width 3° C., tangential-separation temperature: 50° C., Mw = 700, Mw/Mn = 1.2, melt viscosity at 100° C.: 20 mPa.s) | 25 parts by weight |

The theoretical glass transition temperature (Tg) of the copolymer synthesized above from styrene and n-butyl acrylate is calculated to be 59° C.

After the agitation, 4 parts by weight of 2,2'azobis(2,4-dimethylvaleronitrile) was added to the mixture. The resulting polymerizable monomer composition was poured into the aforementioned aqueous dispersion medium, and agitated with the high-speed agitator at 10,000 rpm for 5 minutes to form dispersion particles. Then the high speed agitator is replaced by a propeller type stirrer, and the temperature of the mixture is raised to 70° C. The polymerization is allowed to proceed with gentle stirring for 10 hours to obtain polymer particles (toner particles).

Subsequently, the content in the vessel is heated to 90° C., and was maintained at this temperature for 300 minutes, and then cooled at a cooling rate of 1° C. per minute down to 30° C. Thereto, dilute hydrochloric acid was added to remove the dispersion stabilizer. The formed particles were collected by filtration, washed, and dried to obtain an electricity-insulating particulate cyan toner having a weight-average particle diameter of 6.4 μm, and a variation coefficient of 29% in particle number distribution.

FIG. 1 shows schematically the cross-sectional view of the toner particle observed by transmission electron microscopy. The core is constituted of a low-temperature softening substance, namely an ester wax. The core is covered with an inner layer which is constituted of a styrene-n-butyl acrylate copolymer having a GPC peak at molecular weight of 23,000 and a glass transition temperature (Tg) of 62° C. The inner layer is covered with an outer layer which is about 0.15 μm thick and is composed of a polyester resin.

2% by weight of fine particulate hydrophobic titanium oxide was externally added to the obtained particulate cyan toner to prepare a final cyan toner having high fluidity. A two-component developing agent was prepared by blending 6 parts by weight of the resulting cyan toner and 94 parts by weight of ferrite carrier which was coated with silicone resin with average particle diameter of 40 μm.

The two-component developing agent was evaluated for formation of copying images in a cyan color mode at ordinary temperature and ordinary humidity, and at ordinary temperature and low humidity by means of a modified commercial digital full-color copying machine CLC-700 provided with an OPC photosensitive member. At ordinary temperature and ordinary humidity, the efficiency of transfer from the photosensitive drum surface was 97% at the initial stage of the test, and high density of image was obtained without toner transfer defect like blank area. During running test of 50000 sheets, the transfer efficiency was maintained invariably at about 95%, and the copied image quality did not change significantly. Fusion adhesion of the toner to the photosensitive drum and other members was not observed. At ordinary temperature and low humidity, the results were the same as above. The results are shown in Table 3 and Table 4.

EXAMPLES 2–7 and COMPARATIVE EXAMPLES 1–5

Particulate toners were prepared and therefrom two-component developing agents were prepared, and evaluation was conducted in the same manner as in Example 1 except that the material is changed as shown in Table 1. The results are shown in Tables 2, 3, and 4.

COMPARATIVE EXAMPLE 6

A particulate toner was prepared and therefrom a two-component developing agent was prepared, and evaluation was conducted in the same manner as in Example 1 except that the polymerization was conducted at 70° C., then the reaction mixture was heated and kept at 90° C., and thereafter the mixture was cooled from 90° C. to 30° C. at a cooling rate of 5° C. per minutes. The results are shown in Tables 2, 3, and 4.

Measurement of Image Density

The optical density of a solid image portion was measured by means of a McBeth Densitometer with SPI complementary color filters.

Measurement of Toner Transfer Efficiency

The toner transfer efficiency was measured in the initial stage of, and at the end of 50000-sheet running test of image formation as follows. In the cyan image-forming unit, a cyan toner image was formed on a photosensitive drum, and the formed image was collected by a transparent adhesive tape. The optical density ($D_1$) of the image collected onto the tape was measured by a McBeth Densitometer. Then, the same cyan toner image was formed again on the photosensitive drum, and was transferred onto a recording medium. The transferred cyan toner image was collected by the transparent adhesive tape. The optical density ($D_2$) of the collected image was measured in the same manner as above. The toner transfer efficiency was calculated from the equation below:

$$\text{Transfer efficiency } (\%)=(D_2/D_1)\times 100$$

Non-occurrence of Fusion-Adhesion of Toner on Surface of OPC Photosensitive Member After the 50000-sheet running test under the conditions of ordinary temperature and low humidity (20° C., 5% RH), the surface of the OPC photosensitive member was examined visually for occurrence of the toner fusion adhesion thereon. Further, a half-tone image was reproduced, and image defects caused by the toner fusion adhesion was checked in comparison with a standard sample.

Evaluation of Low-Temperature Fixability and High-Temperature Offset Resistance An unfixed toner image was formed on a transfer paper (basis weight: 80 g/m$^2$) by means of a modified commercial full-color digital copying machine (CLC-700, manufactured by Canon K.K.). The unfixed toner was fixed onto the recording paper sheet by oilless hot-pressing by means of a separate external hot-pressing roller fixer which does not have an oil application device but has a fixing temperature-controlling device. The employed hot-pressing roller fixer had a fixing roller surface or a heating roller surface formed from a fluororesin, and a pressing roller surface formed from a fluororesin. The fixation test was conducted at a roller nip of 5.5 mm, a fixation speed of 120 mm/sec, and at temperatures changed at 5° C. intervals from 120° C. to 240° C.

The fixed images were rubbed twice respectively with a silbon paper sheet [Lenz Cleaning Paper "Dasper (R)" (Ozu Paper Co. Ltd)] under a load of 50 g/cm$^2$, and the image density drop by the rubbing was measured. The temperature at which the image density drop ratio by the rubbing reaches 10% or less was defined as a fixation initiation temperature. The low-temperature fixability was evaluated according to the fixation initiation temperature (Fix. Initn. Temp.) on the grades below:

Excellent: 120° C.≦(Fix. Initn. Temp.)≦140° C.

Good: 140° C.<(Fix. Initn. Temp.)≦160° C.

Fair: 160° C.<(Fix. Initn. Temp.)≦180° C.

Unacceptable: 180° C.<(Fix. Initn. Temp.)

The fixed images and the fixing roller surface were observed visually at the respective fixation temperatures. The high-temperature offset resistance was evaluated at the temperature at which the high-temperature offset (Offset Initn. Temp.) was caused, on the grades below:

Excellent: 210° C.≦(Offset Initn. Temp.)

Good: 200° C.≦(Offset Initn. Temp.)<210° C.

Fair: 190° C.≦(Offset Initn. Temp.)<200° C.

Poor: 180° C.≦(Offset Initn. Temp.)<190° C.

Unacceptable: (Offset Initn. Temp.)<180° C.

Evaluation of Non-sticking of Recording Paper Sheet to Fixing Roller

In the fixation of a solid toner image onto a recording paper sheet (basis weight: 80 g/m$^2$) with the aforementioned separated external roller fixer, the lowest temperature, sticking initiation temperature (Stickg. Initn. Temp.), was measured at which the recording paper sheet comes to stick to the fixation roller and the roller is wound with the recording paper sheet. Sticking to the fixing roller was evaluated according to the sticking initiation temperature on the grades below:

Good: 200° C.≦(Stickg. Initn. Temp.)

Poor: 180° C.≦(Stickg. Initn. Temp.)<200° C.

Unacceptable: (Stickg. Initn. Temp.)<180° C.

EXAMPLES 8–10

A magenta toner particle, a yellow toner particle, and a black toner particle were prepared in the same manner as in Example 1 by using 17 parts by weight of a magenta colorant (C.I. Pigment Red 122), 13 parts by weight of a yellow colorant (C.I. Pigment Yellow 173), or 15 parts by weight of a black colorant (grafted carbon black) in place of the phthalocyanine. The results are shown in Table 5.

Subsequently, two-component developing agents were prepared for respective colors in the same manner as in Example 1.

EXPERIMENT EXAMPLE

A color image was reproduced in a full-color mode by use of the two-component cyan developing agent obtained in Example 1, the two-component magenta developing agent obtained in Example 8, the two-component black developing agent obtained in Example 10. As the results, the original image was reproduced precisely in full color.

In the full-color image formation, offset did not occur even without applying silicone oil onto the fixing roller, and double-sided image fixing could be conducted on a plain paper sheet without trouble in the fixation step.

TABLE 1

Properties of Materials Employed in Examples and Comparative Examples

| | Low-temperature softening substance | | | | | | | |
|---|---|---|---|---|---|---|---|---|
| | | | | Endothermic curve in DSC | | | | Amount of |
| | Type of ester wax | Mw | Mw/Mn | Main peak temperature | Main peak half-width | Tangential-separation temperature | Viscosity (100° C.) | addition (% by weight) |
| Example | | | | | | | | |
| 1 | (6) | 700 | 1.2 | 81° C. | 3° C. | 50° C. | 25 mPa · s | 10% |
| 2 | (6) | 450 | 1.1 | 67° C. | 3° C. | 43° C. | 12 mPa · s | 25% |
| 3 | (4) | 500 | 1.2 | 75° C. | 4° C. | 60° C. | 21 mPa · s | 7% |
| 4 | (5) | 800 | 1.3 | 85° C. | 4° C. | 48° C. | 34 mPa · s | 15% |
| 5 | (6) | 1100 | 1.4 | 95° C. | 5° C. | 55° C. | 46 mPa · s | 20% |
| 6 | (3) | 360 | 1.6 | 73° C. | 6° C. | 38° C. | 8 mPa · s | 25% |
| 7 | Fischer-Tropsche wax | 1300 | 1.6 | 113° C. | 17° C. | 68° C. | — | 10% |
| Comparative Example | | | | | | | | |
| 1 | — | — | — | — | — | — | — | — |
| 2 | Polyethylene wax | 2500 | 1.8 | 125° C. | 35° C. | 90° C. | — | 3% |
| 3 | (6) | 700 | 1.2 | 81° C. | 3° C. | 50° C. | 25 mPa · s | 10% |
| 4 | (6) | 700 | 1.2 | 81° C. | 3° C. | 50° C. | 25 mPa · s | 10% |
| 5 | Paraffin | 290 | 1.8 | 54° C. | 12° C. | 23° C. | 3 mPa · s | 35% |

TABLE 2

| | Binder for inner layer | | Polyester resin for outer layer | | | Toner particle | | | |
|---|---|---|---|---|---|---|---|---|---|
| | Tg (°C.) | Main peak (Molecular weight) | Tg (°C.) | Acid value | Amount of addition (parts by weight) | Layer structure | Outer layer thickness (μm) | Weight-average diameter (μm) | Variation coefficient (%) |
| Example | | | | | | | | | |
| 1 | 59 | 23,000 | 60 | 13 | 7 | 3-layered | 0.13 | 6.4 | 29 |
| 2 | 80 | 38,000 | 75 | 8 | 13 | 3-layered | 0.35 | 6.7 | 28 |
| 3 | 55 | 17,000 | 58 | 29 | 5 | 3-layered | 0.09 | 6.5 | 30 |
| 4 | 67 | 25,000 | 65 | 18 | 10 | 3-layered | 0.17 | 6.2 | 27 |
| 5 | 52 | 19,000 | 68 | 24 | 3 | 3-layered | 0.07 | 6.0 | 21 |
| 6 | 60 | 12,000 | 60 | 5 | 16 | 3-layered | 0.44 | 5.8 | 32 |
| 7 | 35 | 10,000 | 70 | 18 | 20 | 3-layered | 0.48 | 7.8 | 36 |
| Comparative Example | | | | | | | | | |
| 1 | 62 | 23,000 | 60 | 13 | 7 | No core, 2-layered | 0.13 | 6.5 | 30 |
| 2 | 62 | 23,000 | 60 | 13 | 7 | No core, 2-layered | 0.13 | 8.2 | 39 |
| 3 | 62 | 9,000 | — | — | — | No outer layer | — | 9.5 | 42 |
| 4 | 62 | 9,000 | 60 | 13 | 0.5 | No outer layer | — | 8.8 | 40 |
| 5 | 47 | 8,000 | 52 | 2 | 1 | No outer layer | — | 9.3 | 41 |
| 6 | 59 | 23,000 | 60 | 13 | 7 | No outer layer | — | 8.0 | 34 |

TABLE 3

| | Results of Evaluation of Toner | | | | | | | |
|---|---|---|---|---|---|---|---|---|
| | Ordinary temperature & ordinary humidity (23° C., 60% RH) | | | | Ordinary temperature & low humidity (20° C., 5% RH) | | | |
| | Initial stage | | 50000-Sheet running test | | Initial stage | | 50000-Sheet running test | |
| | Image density | Transfer-ability | Image density | Transfer-ability | Image density | Transfer-ability | Image density | Transfer-ability |
| Example | | | | | | | | |
| 1 | 1.45 | 97% | 1.47 | 95% | 1.43 | 94% | 1.38 | 90% |
| 2 | 1.44 | 93% | 1.43 | 89% | 1.38 | 90% | 1.40 | 88% |
| 3 | 1.53 | 95% | 1.51 | 91% | 1.47 | 91% | 1.50 | 89% |
| 4 | 1.48 | 92% | 1.45 | 90% | 1.45 | 93% | 1.39 | 88% |
| 5 | 1.55 | 99% | 1.52 | 94% | 1.49 | 95% | 1.47 | 91% |
| 6 | 1.35 | 87% | 1.33 | 85% | 1.32 | 83% | 1.30 | 81% |
| 7 | 1.33 | 88% | 1.34 | 84% | 1.31 | 85% | 1.33 | 83% |
| Comparative Example | | | | | | | | |
| 1 | 1.55 | 98% | 1.51 | 97% | 1.48 | 95% | 1.46 | 89% |
| 2 | 1.44 | 95% | 1.46 | 91% | 1.39 | 87% | 1.34 | 85% |
| 3 | 1.23 | 78% | 1.28 | 70% | 1.25 | 73% | 1.21 | 68% |
| 4 | 1.28 | 79% | 1.26 | 71% | 1.27 | 75% | 1.26 | 68% |
| 5 | 1.22 | 74% | 1.18 | 65% | 1.17 | 69% | 1.23 | 63% |
| 6 | 1.25 | 78% | 1.20 | 72% | 1.27 | 71% | 1.22 | 69% |

TABLE 4

| | Fixing characteristics | | | Fusion adhesion of toner onto OPC photo- |
|---|---|---|---|---|
| | Low-temperature fixability | High-temperature offset resistance | Non-sticking to fixing roller | sensitive member after running test |
| Example | | | | |
| 1 | Good | Good | Good | Not adhered |
| 2 | Excellent | Excellent | Good | Not adhered |
| 3 | Good | Good | Good | Not adhered |
| 4 | Good | Good | Good | Not adhered |
| 5 | Good | Good | Good | Not adhered |
| 6 | Good | Fair | Good | Not adhered |
| 7 | Fair | Fair | Poor | Slightly adhered |
| Comparable Example | | | | |
| 1 | Unacceptable | Unacceptable | Unacceptable | Adhered |
| 2 | Unacceptable | Poor | Unacceptable | Adhered |
| 3 | Good | Good | Good | Slightly adhered |
| 4 | Good | Good | Good | Slightly adhered |
| 5 | Good | Fair | Poor | Adhered |
| 6 | Good | Fair | Poor | Slightly adhered |

TABLE 5

| | Binder for inner layer | | | Polyester resin for outer layer | | | Toner particle | | | |
|---|---|---|---|---|---|---|---|---|---|---|
| | Color of toner | Tg (°C.) | Main peak (Molecular weight) | Tg (°C.) | Acid value | Amount of addition (parts by weight) | Layer structure | Outer layer thickness (μm) | Weight-average diameter (μm) | Variation coefficient (%) |
| Example | | | | | | | | | | |
| 8 | Magenta | 59 | 22,000 | 60 | 13 | 7 | 3-Layered | 0.12 | 6.0 | 26 |
| 9 | Yellow | 59 | 23,000 | 60 | 13 | 7 | 3-Layered | 0.14 | 6.3 | 29 |
| 10 | Black | 59 | 21,500 | 60 | 13 | 7 | 3-Layered | 0.12 | 6.1 | 27 |

What is claimed is:

1. A toner for developing an electrostatic image comprising: toner particles each containing a binder resin and a colorant, each said toner particle having at least a core composed of a low-temperature softening substance, an inner layer enclosing the core, and an outer layer enclosing the core and the inner layer; and the core, the inner layer, and the outer layer being constituted respectively of a material which is individually discriminable by staining with triruthenium tetroxide and triosmium tetroxide, wherein said toner particles have a weight-average particle diameter of 4 to 8 μm, said low-temperature softening substance is present in an amount of 5 to 30% by weight and said outer layer has a thickness of 0.01 to 0.5 μm.

2. The toner according to claim 1, wherein the low-temperature softening substance forming a core has a weight-average molecular weight ranging from 300 to 1,500, the ratio of weight-average molecular weight to number-average molecular weight of not higher than 1.5, and an endothermic main peak at a temperature ranging from 55° to 120° C. and a tangential-separation temperature of not lower than 40° C. in DSC.

3. The toner according to claim 1, wherein the inner layer is formed from a vinyl polymer or a vinyl copolymer.

4. The toner according to claim 1, wherein the inner layer is formed from a styrene polymer, a styrene-acrylate copolymer, or a styrene-methacrylate copolymer, which has a glass transition temperature of higher than 50° C. and lower than 100° C.

5. The toner according to claim 1, wherein the outer layer is formed from a polyester resin or a derivative thereof.

6. The toner according to claim 1, wherein the outer layer is formed from a polyester resin having a glass transition temperature ranging from 55° to 80° C. produced from a bisphenol type polyol and an aromatic polycarboxylic acid.

7. The toner according to claim 1, wherein the toner particle has a shape factor SF-1 ranging from 100 to 150.

8. The toner according to claim 1, wherein the toner particle has a shape factor SF-1 ranging from 100 to 125.

9. The toner according to claim 1, wherein the toner has a number-variation coefficient of not higher than 35%.

10. The toner according to claim 1, wherein the toner particles are formed directly by polymerization of a polymerizable monomer in an aqueous medium.

11. The toner according to claim 1, wherein the low-temperature softening substance forming the core has a weight-average molecular weight ranging from 300 to 1,500, the ratio of weight-average molecular weight to number-average molecular weight of not higher than 1.5, and an endothermic main peak at a temperature ranging from 55° to 120° C. and a tangential-separation temperature of not lower than 40° C. in DSC, the inner layer is formed from a vinyl polymer or a vinyl copolymer, and the outer layer is formed from a polyester resin or a derivative thereof.

12. The toner according to claim 11, wherein the inner layer is formed from a styrene polymer, a styrene-acrylate copolymer, or a styrene-methacrylate copolymer having a glass transition temperature of higher than 50° C. and lower than 100° C., and the outer layer is formed from a polyester resin having a glass transition temperature ranging from 55° to 80° C. produced from a bisphenol type polyol and an aromatic polycarboxylic acid.

13. The toner according to claim 11 or 12, wherein the toner particle contains the low-temperature softening substance at a content of from 5 to 30% by weight.

14. The toner according to claim 13, wherein the toner particle contains the low-temperature softening substance at a content of from 10 to 30% by weight.

15. The toner according to claim 13, wherein the outer layer has a thickness ranging from 0.01 to 0.5 μm, and the toner particle has a shape factor SF-1 ranging from 100 to 150.

16. The toner according to claim 15, wherein the toner particle has a shape factor SF-1 ranging from 100 to 125.

17. The toner according to claim 16, wherein the toner has a weight-average particle diameter ranging from 3 to 8 μm, and a number-variation coefficient of not higher than 35%.

18. The toner according to claim 17, wherein the toner particles are formed directly by polymerization of a polymerizable monomer in an aqueous medium.

19. The toner according to claim 11, wherein the low-temperature softening substance is an ester wax, and has an endothermic main peak at a temperature ranging from 60° to 90° C. with an endothermic main peak half-width of not more than 10° C. in DSC.

20. The toner according to claim 19, wherein the ester wax has the endothermic main peak at a temperature ranging from 60° to 85° C., and the endothermic main peak half-width of not more than 5° C.

* * * * *